US007591369B2

(12) United States Patent
Lin et al.

(10) Patent No.: US 7,591,369 B2
(45) Date of Patent: Sep. 22, 2009

(54) SHUTTLECOCKS

(75) Inventors: Mark W. Lin, Hinsdale, IL (US); Thomas E. Korder, Champaign, IL (US); Alexander R. O. Selch, Germering (DE)

(73) Assignee: Wilson Sporting Goods Co., Chicago, IL (US)

( * ) Notice: Subject to any disclaimer, the term of this patent is extended or adjusted under 35 U.S.C. 154(b) by 258 days.

(21) Appl. No.: 10/974,343

(22) Filed: Oct. 27, 2004

(65) Prior Publication Data

US 2006/0089217 A1 Apr. 27, 2006

(51) Int. Cl.
*B65D 81/26* (2006.01)
*B65D 85/84* (2006.01)

(52) U.S. Cl. ..... 206/204; 206/814; 206/205; 312/31.3; 239/43; 239/57

(58) Field of Classification Search ..... 206/204, 206/242, 205, 814; 312/31.3; 239/43, 57
See application file for complete search history.

(56) References Cited

U.S. PATENT DOCUMENTS

| | | | | |
|---|---|---|---|---|
| 1,050,706 | A * | 1/1913 | Taylor | 96/118 |
| 2,443,139 | A * | 6/1948 | Krause | 239/43 |
| 3,049,444 | A * | 8/1962 | Palombo | 428/357 |
| 3,431,038 | A * | 3/1969 | Berliner | 312/31 |
| 4,213,528 | A * | 7/1980 | Kreutz et al. | 206/205 |
| 6,027,187 | A * | 2/2000 | Siepmann | 312/31 |
| 6,194,079 | B1 * | 2/2001 | Hekal | 428/566 |
| 6,274,209 | B1 * | 8/2001 | Pagidas et al. | 428/35.7 |
| 6,837,770 | B2 * | 1/2005 | Ruzicka | 449/2 |
| 2003/0215587 | A1 | 11/2003 | Fatica et al. | 428/34.2 |

FOREIGN PATENT DOCUMENTS

| | | |
|---|---|---|
| DE | 10038351 | 2/2002 |
| WO | WO 03/008295 | 1/2003 |

* cited by examiner

*Primary Examiner*—Jila M Mohandesi
(74) *Attorney, Agent, or Firm*—Terence P. O'Brien; Paul E. Schaafsma

(57) ABSTRACT

Improved shuttlecock packaging includes providing a suitably humid environment to prevent the moisture within the feathers of the shuttlecock from evaporating off. The packaging is substantially air tight and includes a humidity control mechanism. In one embodiment the package comprising a humidifying disc in the shuttlecock packaging. The humidifying disc includes a plurality of openings to allow for moisture to pass from the disc to the internal environment of the packaging and comprises a foam or sponge pad moistened with water and propylene glycol. The humidity within the packaging is held at a generally fixed level. In one embodiment, the relative humidity can be held at least about 20%. In a further embodiment, the relative humidity can be held at about 50%.

13 Claims, 4 Drawing Sheets

SHUTTLECOCKS

BACKGROUND OF THE INVENTION

Numerous types of athletic games using shuttlecocks, also known as shuttles, birds or birdies, are known. The conventional badminton game uses a shuttlecock and at least a pair of racquets for striking a shuttlecock back and forth between players. There also are games similar to badminton where a shuttlecock is struck with the hand, between two or more players with or without a net.

There are two main types of shuttlecocks, those having a flared skirt made of feathers and those having a flared skirt made of plastic material. While often those made of plastic material are used in casual play, for serious badminton play feathered shuttlecocks are used.

Feather shuttlecocks have a cap usually made of cork. An inner skirt is comprised of the stems or quills of the feathers; an outer skirt is comprised of minor stems or the quill extensions that spread into the vanes. In general, the plurality of natural feathers is bound together piece by piece by adhesive glue and threads. In the best feather shuttlecocks, the flared skirts are made of goose or duck wing feathers that overlap in the outer skirt. The preferred shuttlecocks typically use approximately 16 feathers per shuttlecock.

The best shuttlecocks have the following desirable characteristics: the turnover is good; the shuttlecock is rigid; the shuttlecock rotates in flight; when struck severely, there is a resounding 'crack'—a noise pleasing to the player; the inner skirt does not collapse and the shuttlecock decelerates rapidly. A well-known problem with shuttlecocks is the variation in the flight speed of the shuttlecock. This variation is the result of many factors including the inherent characteristics of the shuttlecock, the temperature at the court, the humidity level, altitude, and the amount of time the shuttlecock has been in use.

The performance of shuttlecock is further diminished due to the bleaching process to which the feathers of the shuttlecocks are subjected. This bleaching process reduces the natural moisture in the feathers produced by the uropygial glands of the bird. The uropygial glands secrete a natural oil referred to as preen oil. The reduction of these natural oils can result in the bird feathers becoming dry, brittle and susceptible to cracking.

In normal recreational play, a single shuttlecock will last between 30 minutes to an hour. Particularly among the more skilled players, after a shuttlecock has been used for between 5-10 minutes, the 'speed' of the shuttlecock increases beyond a level considered desirable. In competitive matches, a shuttlecock will typically be replaced approximately every 4 minutes. A game typically takes about 30 minutes to complete. Shuttlecocks are typically sold in packages of 6 or 12. Thus, in competitive match play, several packages of shuttlecocks can be used.

It would thus be desirable to provide for an improved shuttlecock whereby the likelihood of improved turnover, shuttlecock rigidity, flight rotation, a resounding 'crack', and the shuttlecock deceleration is provided. It would further be desirable to provide for an improved shuttlecock whereby the likelihood of variation in the flight speed of the shuttlecock is minimized.

SUMMARY OF THE INVENTION

An improved shuttlecock in accordance with the present invention provides for an increased likelihood of improved turnover, shuttlecock rigidity, flight rotation, a resounding 'crack', and the shuttlecock deceleration. An improved shuttlecock in accordance with the present invention provides for an increased likelihood for minimizing variation in the flight speed of the shuttlecock.

In accordance with the principles of the present invention, improved shuttlecocks are provided by applying innovative packaging. The improved shuttlecocks are packaged in a suitably humid environment to prevent the moisture within the feathers of the shuttlecock from evaporating off. The packaging is substantially airtight and includes a humidity control mechanism. In one embodiment the package comprising a humidifying disc in the shuttlecock packaging. The humidifying disc includes a plurality of openings to allow for moisture to pass from the disc to the internal environment of the packaging and comprises a foam or sponge pad moistened with water and propylene glycol. The humidity within the packaging is held at a generally fixed level. In one embodiment, the relative humidity can be held at least about 20%. In a further embodiment, the relative humidity can be held at about 50%.

DETAILED DESCRIPTION OF THE INVENTION

Efforts in the prior art to provide for an improved shuttlecock have typically focused on the structure of the shuttlecocks themselves. In accordance with the principles of the present invention, improved shuttlecocks are provided by applying a innovative paradigm whereby the packaging of the shuttlecocks provides for an increased likelihood of improved turnover, shuttlecock rigidity, flight rotation, a resounding 'crack', rapid deceleration, and an increased likelihood for minimizing variation in the flight speed of the shuttlecock.

As previously described, the best shuttlecocks have approximately 16 goose or duck feathers per shuttlecock. In particular, to ensure consistency and proper curvature of the feathers, premium grade shuttlecocks typically include feathers obtained only from the left wing of the goose or duck. The feathers contain moisture produced by the uropygial glands of the goose or duck, so it is desirable to keep them in a suitably humid environment to prevent the moisture within the feathers from evaporating off. Dried out feathers become brittle, and are much more susceptible to cracking.

Figure 1:
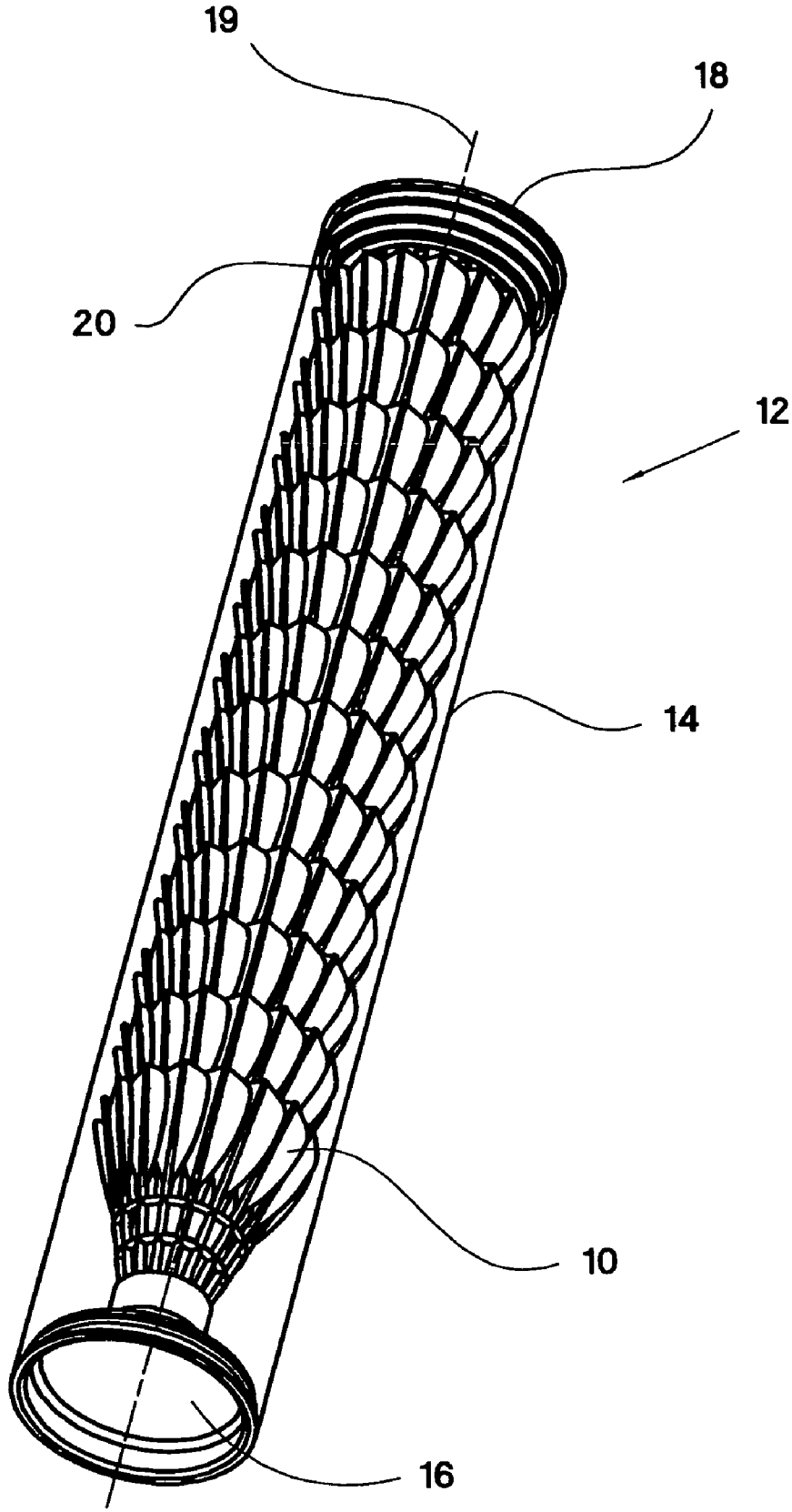
FIG. 1 is a perspective view of shuttlecocks packaged in accordance with a preferred embodiment of the present invention.

In accordance with the principles of the present invention, the improved shuttlecocks 10 are packaged in a package of shuttlecocks 12 that comprises an elongate tubular member 14, a first and second end caps 16 and 18, and a humidity control mechanism 20. Referring to FIG. 1, a perspective view of the shuttlecocks 10 packaged in accordance with the present invention is seen. The package 12 of the shuttlecocks 10 is preferably formed with the tubular member having a tubular shape into which the shuttlecocks 10 are stacked. The tubular member 14 extends along a longitudinal axis 19. The diameter of the tubular member 14 is preferably slightly larger than the diameter of the shuttlecocks 10. In one embodiment, the inner diameter of the tubular member 14 can be about 2.5 inches. The length of the tubular member 14 depends on the number of shuttlecocks 10 packaged, typically 6 or 12, but other numbers of shuttlecocks 10 can also be used. In one embodiment, the length of the package 12 can be about 15.5 inches to package 12 shuttlecocks. Other sizes and shapes including alternative diameters and lengths for the package 12 and the tubular member 14, are also contemplated. The package can have a non-circular cross-section, such as, for example, oval, rectangular and polygonal. The packaging 12 is substantially airtight, preferably through the use of substantially air tight seals positioned at each end of the tubular member 14.

In a preferred embodiment, the tubular member 14 can be made of a clear plastic thereby exposing the packaged shuttlecocks 10 to visual inspection. In one particularly preferred embodiment, the tubular member 14 comprises a Mylar® polyester film coating, which is used in combination with rubber seals to create the airtight environment. The Mylar® polyester film is available from DuPont Teijin Films U.S. Limited Partnership, 1 Discovery Drive, P.O. Box 411, Hopewell, Va. 23860 USA. In alternative preferred embodiments, the tubular member 14 can be formed of other materials, such as, example other plastics, other polymers, glass, wood or combinations thereof. In other alternative preferred embodiments, the tubular member can be formed of a material, or materials, that are translucent, colored, transparent, semi-transparent or combinations thereof. The tubular member 14 provides structural support to the package 12 and serves to protect the shuttlecocks 10 from damage particularly when being transported. The tubular member 14 also helps provide the package 12 with the preferred substantially air tight inside environment. Still further, the tubular member 14 also preferably includes indicia 22, which can be graphical indicia, alphanumeric indicia or combinations thereof. The indicia 22 can include source indicators, trademarks, instructions for use, product identifiers, warning labels and other information or symbols.

The first and second end caps 16 and 18 are generally flat, and preferably circular, members that enclose first and second ends of the tubular member 14, respectively. Preferably, the first and second end caps 16 and 18 are attached to the first and second ends of the tubular member 14 to form a substantially air tight seal. Additional components may be employed to further support the substantially air tight seal, such as, for example, a seal, an o-ring, an adhesive or a wrapping. The first and/or second end caps 16 can be fixedly secured to the first and second ends of the tubular member 14, respectively, through an adhesive, thermal bonding or other conventional means. In alternative preferred embodiments, the first and second end caps 16 and 18 can be secured to the first and second ends of the tubular member 14, respectively, through a recloseable snap fit or threaded connection. The first and second end caps 16 and 18 are preferably formed of an aluminized Mylar® material. Alternatively, other materials can also be used such as, for example, plastic, aluminum, other metals, other polymers, natural rubber, synthetic rubber, or combinations thereof.

Figure 2:
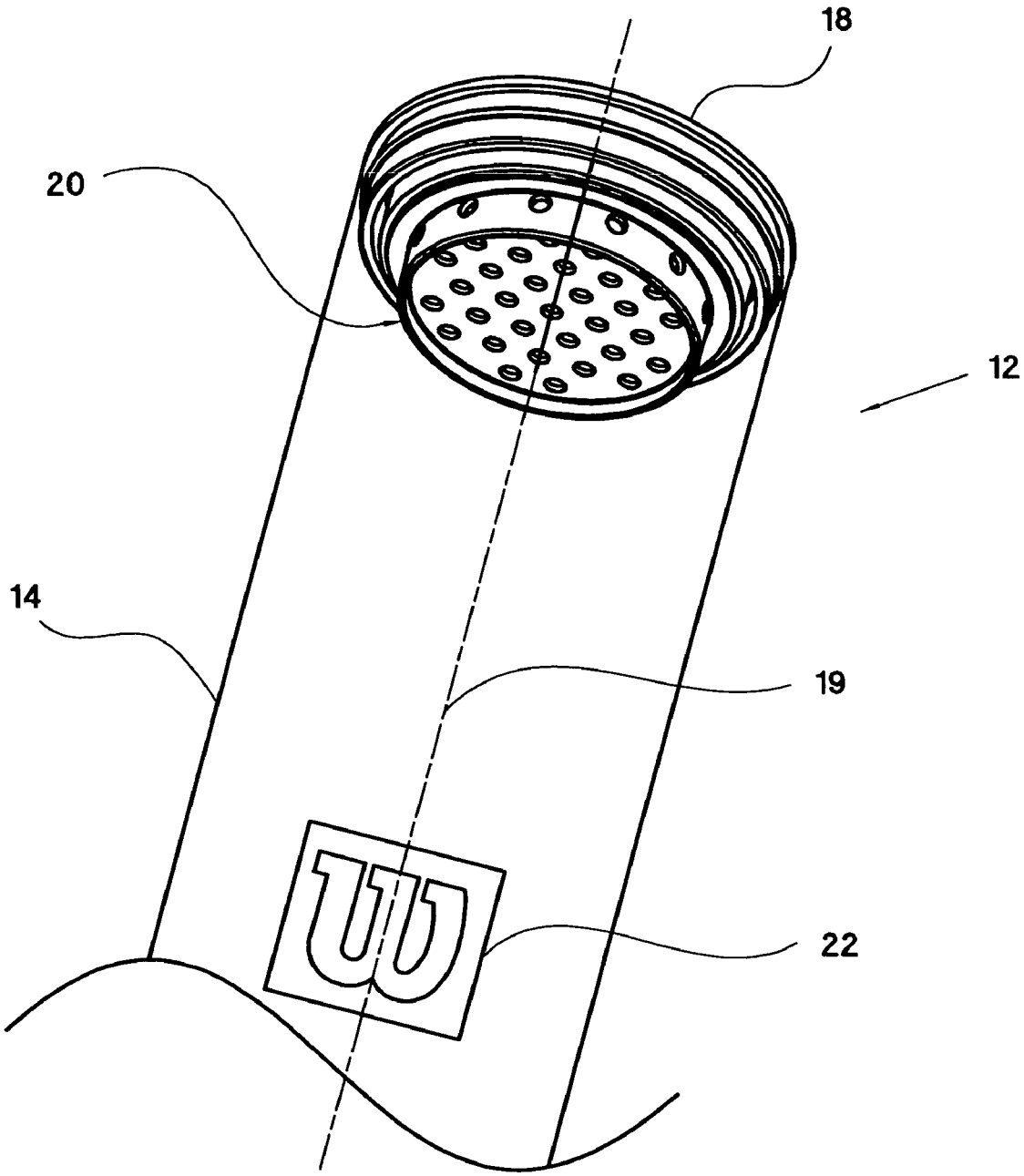
FIG. 2 is a perspective detailed view of a second end of the shuttlecock package of FIG. 1, including a humidity control mechanism.
Figure 3:
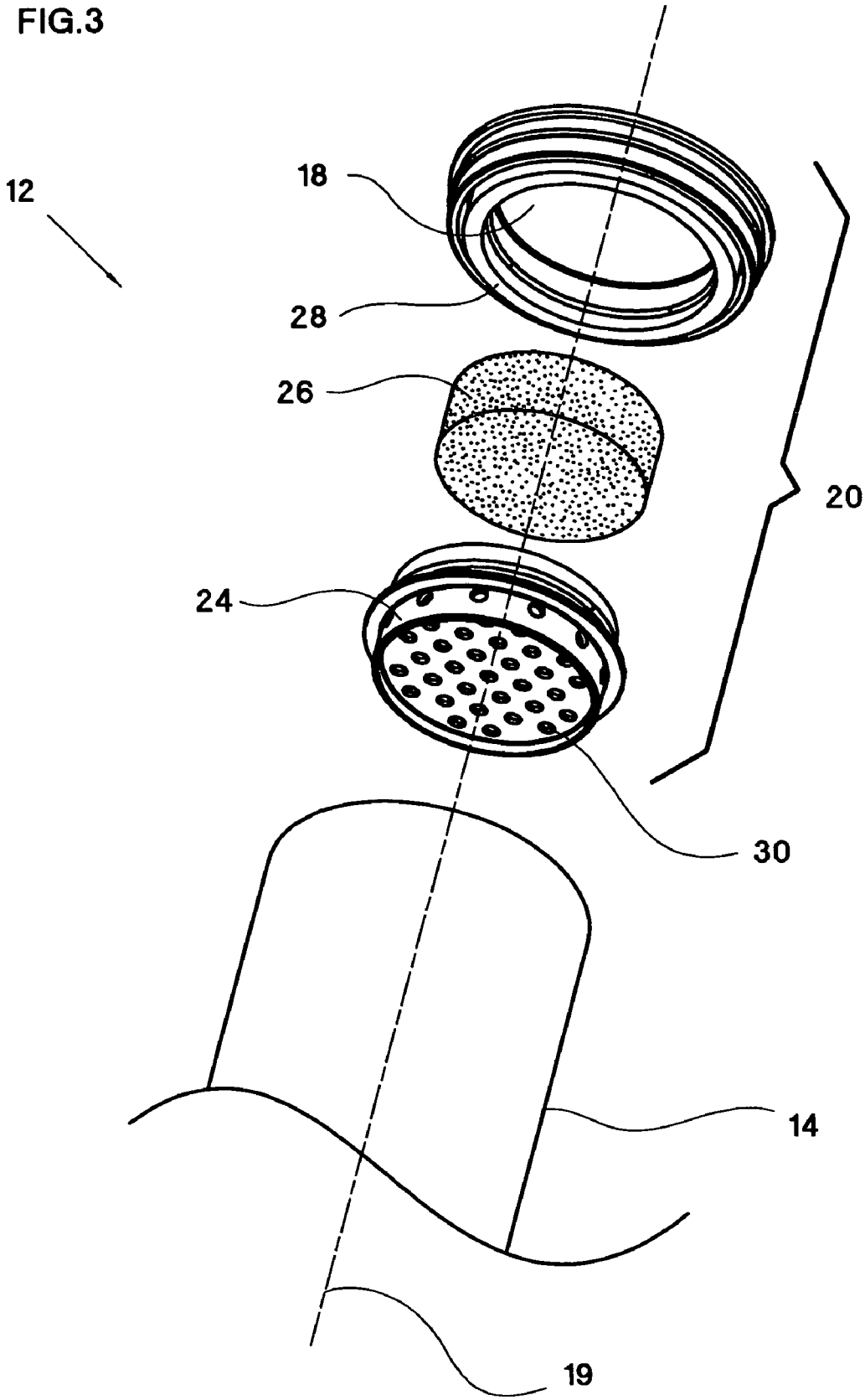
FIG. 3 is an exploded view of the second end of the shuttlecock packaging of FIG 2.

Referring to FIGS. 2 and 3, the second end cap 18 and the humidity control mechanism 20 are shown in greater detail. In a preferred embodiment, the humidity control mechanism 20 can comprise a humidifier housing 24 and a humidifying disc 26 positioned at the second end of the tubular member 14 of the package 12. The housing 24 is an air permeable enclosure configured to attach to the second end cap 18 and to enclose, or partially enclose, the humidifying disc 26. Preferably, the second end cap 18 includes inwardly extending annular wall assembly 28 configured to connect with the housing 24. In one particularly preferred embodiment, the annular wall assembly 28 includes two walls for engaging the housing 24. The engagement can be a threaded engagement or a snap-fit type connection. Alternatively, the annular wall assembly can include a single wall or other shape to accommodate a connection with the housing. The connection between the second end cap and the housing can be releasable or permanent and accomplished through any conventional fastening means.

The housing 24 preferably includes a plurality of openings 30 for allowing air and moisture to pass through the housing 24 between the humidifying disc and the internal environment of the package 12. The housing 24 is preferably formed of a plastic. Alternatively, other materials can also be used such as, for example, aluminum, other metals, a Mylar® material, other polymers, natural rubber, synthetic rubber, or combinations thereof. In an alternative preferred embodiment, the humidity control mechanism 20 can be formed without a housing, wherein the humidifying disc is coupled to the second end cap or other location within the package.

The humidifying disc 20 is a moisture containing substance formed to fit within, or attach to the housing 24 and the second end cap 18. Preferably, the humidifying disc 20 is a foam or sponge pad moistened with water, preferably distilled water, and propylene glycol. In one particularly preferred embodiment, the foam or sponge pad can be a liquid absorbing foam, such as those used in the floral and horticulture industries. Such liquid absorbing foam is an open-celled phenolic foam that readily absorbs liquid. The foam exhibits wicking or capillary action, which draws liquid to the top of the foam. Due to its structure, the foam retains liquid in the cells, and can hold over 40 times its weight in liquid. One such foam is sold under the brand name Oasis® and is available from Smithers-Oasis Company, Smithers-Oasis North America, 919 Marvin Street, Kent, Ohio 44240, USA.

Propylene glycol is a hydroscopic material that absorbs excess moisture. In one preferred embodiment, the ratio of the distilled water and propylene glycol can be about 1:1. Alternatively, other ratios can also be used. In operation, the humidifying disc regulates the humidity within the internal environment of the package 12. If the humidity level within the package is too low, water vapor exits the disc and enters the internal environment of the package 12 to produce or increase the level of humidity in the package 10. If the humidity gets too high, the propylene glycol absorbs some of the water to reduce the humidity level. The propylene glycol also, importantly, prevents mold growth or formation. Specifically, mold growth is substantially prevented by maintaining the relative humidity within the package 12 under approximately 85 percent.

In a preferred embodiment, the humidifying disc 12 enables the humidity within the container to be maintained at a generally fixed level. Preferably, the relative humidity can be at least about 20%. In a further preferred embodiment, the range of relative humidity can be about 30-70%. In a further preferred embodiment, the range of relative humidity can be about 40-60%. In yet another alternative preferred embodiment, the relative humidity level can be approximately 50%.

The humidity control mechanism 20 is preferably attached to the second end cap 18. In alternative preferred embodiments, the humidity control mechanism 20 can be attached to the first end cap, or any location within or in communication with the internal environment of the package.

The humidity control mechanism 20 provides a reliable, cost effective means for improving the internal environment of shuttlecock packaging, thereby improving the life and performance of the shuttlecocks stored within the package. The improved shuttlecock package 12 of the present invention helps to keep the shuttlecocks in a like new condition with an increased likelihood of improved: turnover, rigidity, flight rotation, sound upon impact, and deceleration. The present invention will assist in maximizing the playable life and storage life of the shuttlecocks. The improved shuttlecock package can extend the usable life of the shuttlecocks and may enable a match to be played with fewer shuttlecocks.

Figure 4:
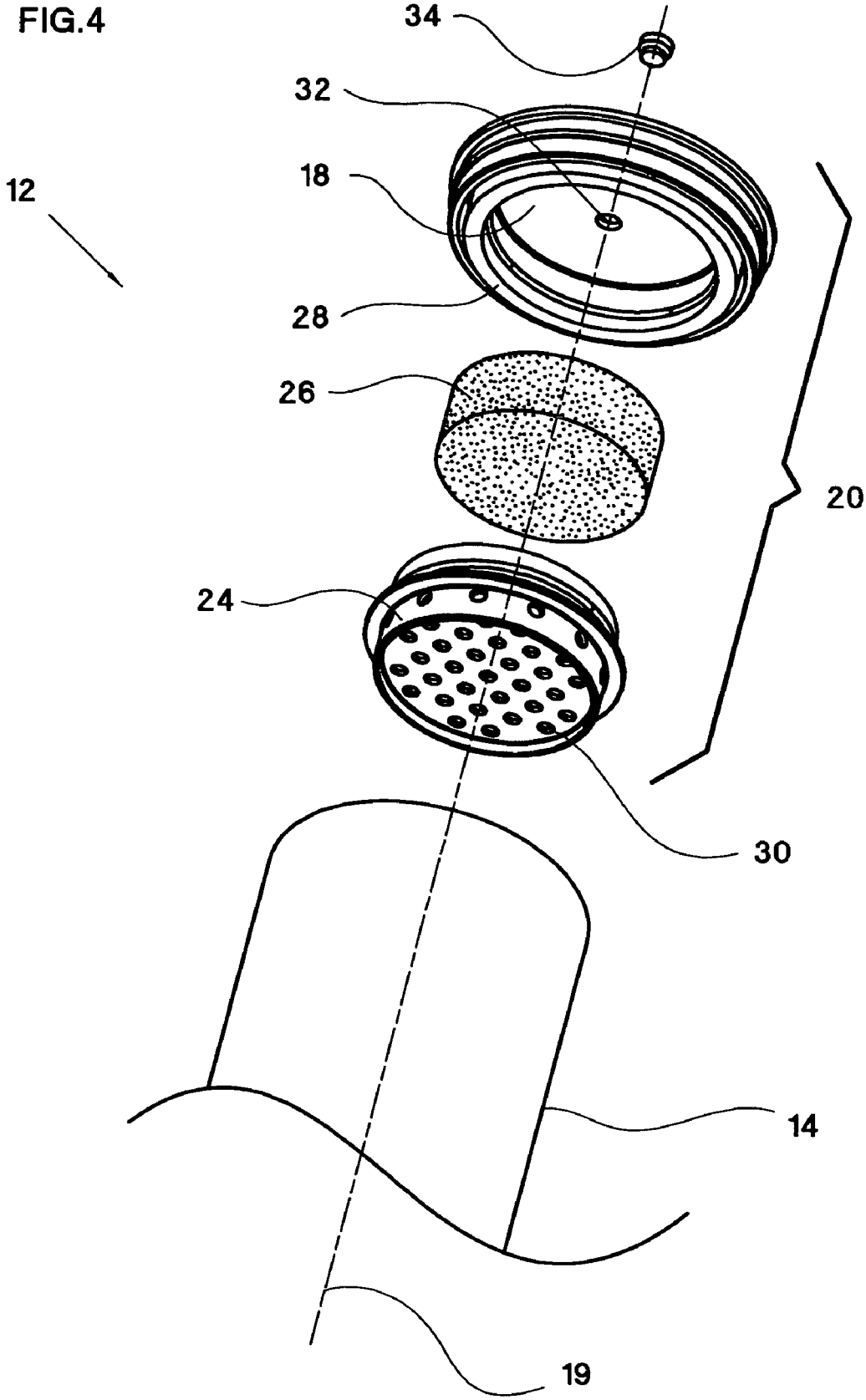
FIG. 4 is an exploded view of the second end of the shuttlecock packaging and the humidity control mechanism in accordance with an alternative preferred embodiment of the present invention.

Referring to FIG 4, in another alternative embodiment, blotter paper, or an equivalent material, can be used in lieu of the humidifying disc. A small amount of water would be added to a piece or pieces of the blotter paper within the container and this moistened paper would provide a similar function as the other embodiment. Blotter paper however is typically much more expensive than propylene glycol. The second end cap 18 can include an aperture 32 and a plug 34 can be used to open or seal the aperture 32. The plug and aperture can be used to enable water or other solution to be added to the blotter paper, or other humidity controlling device, to adjust or replenish the moisture, or solution content within the humidity control mechanism. In other alternative preferred embodiments, the humidity level within the package 12 can be adjusted using mechanical means, electromechanical means or through electronic means.

While the preferred embodiment of the invention has been illustrated and described, it will be appreciated that various changes can be made therein without departing from the spirit and scope of the invention. For example, while the embodiment described herein is primarily for shuttlecock containers, the principles of the present invention could also be used for additional sporting goods in which the need to maintain an environment with humidity is desirable. One such sporting good which need to maintain an environment with humidity is racquet replacement string. Other sporting goods could include, for example, tennis balls, golf balls, ball gloves, racquet balls, game balls, etc. Accordingly, it will be intended to include all such alternatives, modifications and variations set forth within the spirit and scope of the appended claims.

What is claimed is:

1. Shuttlecock packaging for retaining at least one shuttlecock, the packaging comprising:

a shuttlecock storage region for retaining the at least one shuttlecock, at least a portion of the shuttlecock storage region being formed of a generally transparent material configured to expose at least one shuttlecock to visual inspection; and a humidity control mechanism for maintaining the humidity within the packaging within a predetermined range of at least 20 percent, the humidity control mechanism comprising;

a humidifying disc including a pad moistened with water and propylene glycol, and a non-fabric housing for at least partially enclosing the disc and separating the disc from the at least one shuttlecock, the housing having a plurality of openings for allowing air and moisture to pass through the housing between the disc and the shuttlecock storage region, the packaging being substantially airtight.

2. The shuttlecock packaging of claim 1 further wherein the shuttlecock storage region includes indicia selected from the group consisting of graphical indicia, alphanumeric indicia and combinations thereof.

3. The shuttlecock packaging of claim 2 further wherein the indicia includes one or more source indicators, trademarks, instructions for use, product identifiers, warning labels and symbols.

4. The shuttlecock packaging of claim 1 further wherein the humidifying disc comprises an open-celled phenolic foam.

5. The shuttlecock packaging of claim 1 further wherein the packaging comprises a polyester film coating and rubber seals used to create a substantially air tight environment.

6. The shuttlecock packaging of claim 1 further wherein the predetermined range is a generally fixed relative humidity level.

7. The shuttlecock packaging of claim 6 further wherein the predetermined range is a relative humidity of between about 30-70 percent.

8. The shuttlecock packaging of claim 6 further wherein the predetermined range is a relative humidity of between about 40-60%.

9. The shuttlecock packaging of claim 6 further wherein the predetermined range is a relative humidity of about 50%.

10. The improved shuttlecock of claim 1, wherein the package includes first and second end caps, and wherein the humidity control mechanism is coupled to one of the first and second end caps.

11. The improved shuttlecock of claim 10, wherein the end cap coupled to the humidity control mechanism includes an aperture providing an opening between the outside environment and the humidity control mechanism, and wherein the packaging further comprises a plug releaseably connected to the end cap and substantially closing the aperture.

12. Shuttlecock packaging for retaining at least one shuttlecock, the packaging comprising:

a shuttlecock storage region for retaining the at least one shuttlecock, at least a portion of the shuttlecock storage region being formed of a generally transparent material configured to expose at least one shuttlecock to visual inspection, the storage region including indicia selected from the group consisting of graphical indicia, alphanumeric indicia and combinations thereof; and a humidity control mechanism for maintaining the humidity within the packaging within a predetermined range of at least 20 percent, the humidity control mechanism including a liquid absorbing paper, the packaging being substantially airtight.

13. The shuttlecock packaging of claim 12 further wherein the liquid absorbing paper is blotter paper.

* * * * *